US005444941A

United States Patent [19]

Gallenschütz

[11] Patent Number: 5,444,941

[45] Date of Patent: Aug. 29, 1995

[54] MANTRAP

[75] Inventor: Thomas Gallenschütz, Bühl/Baden, Germany

[73] Assignee: Gallenschütz Sicherheitstechnik GmbH, Bühl/Baden, Germany

[21] Appl. No.: 228,119

[22] Filed: Apr. 15, 1994

[30] Foreign Application Priority Data

Apr. 16, 1993 [DE] Germany ..... 43 12 477.1

[51] Int. Cl.[6] ..... E06B 11/08

[52] U.S. Cl. ..... 49/42; 49/44; 49/141

[58] Field of Search ..... 49/42, 43, 44, 45, 141; 109/8

[56] References Cited

U.S. PATENT DOCUMENTS

| | | | |
|---|---|---|---|
| 2,258,896 | 10/1941 | Kelker, Jr. | 49/42 |
| 3,839,825 | 10/1974 | Nica | 49/42 |
| 4,184,289 | 1/1980 | Lambertson | 49/42 |
| 4,255,900 | 3/1981 | Magnani | 49/141 |
| 4,358,909 | 11/1982 | Trikilis | 49/42 |
| 4,562,665 | 1/1986 | Blackston | 49/44 |
| 4,640,046 | 2/1987 | Rushford | 49/42 X |

FOREIGN PATENT DOCUMENTS

| | | | |
|---|---|---|---|
| 2631211 | 1/1978 | Germany | 49/42 |

*Primary Examiner*—Philip C. Kannan
*Attorney, Agent, or Firm*—Max Fogiel

[57] ABSTRACT

A mantrap in which a demarcation in shape of a segment of an arc is provided at one side of a passage. The open side of the demarcation faces the other side of the passage. The demarcation extends, furthermore, along a predetermined angle of circumference and has a barrier element that rotates around a vertical axis positioned approximately in the center of the demarcation and is provided with leaves extending out from the vertical axis of rotation and including equal angles. The leaves have grating rods positioned separately and one above another. A barrier rake extends out from an axis of the barrier element to the other side of the passage, and has grating rods displaced in position from the grating rods in the leaves and one above another. The barrier-rake rods allow unimpeded rotation of the barrier element. The barrier rake, furthermore, is a gate element, and the barrier element is a rotating door with at least two leaves.

11 Claims, 3 Drawing Sheets

MANTRAP

BACKGROUND OF THE INVENTION

The present invention concerns a mantrap. It has a demarcation in the shape of a segment of an arc at one side of a passage. The open side of the demarcation faces the other side of the passage. The demarcation extends along a prescribed angle of circumference. It has a barrier element that rotates around a vertical axis positioned approximately in the center of the demarcation. The barrier element is provided with leaves. The leaves extend out from the axis of rotation while including preferably equal angles and consist of grating rods positioned separated and one above another. The mantrap also has a barrier rake extending out from the axis of the barrier element to the other side of the passage. The barrier rake consists of grating rods positioned displaced from the grating rods in the leaves and one above another. The barrier-rake rods allow unimpeded rotation of the barrier element.

A known barrier element is described in sales literature published by the present applicants. It rotates around an upright axis. It consists of a turnstile with three leaves displaced in relation to one another at angles of 120°. A demarcation in the shape of an arc of a circle is positioned on one side of the passage and extends over a circumferential angle of approximately 120°. The system is designed to ensure that, as long as the barrier element is symmetrical to the demarcation, any gaps that occur between the ends of the demarcation and the ends of the barrier-element leaves will be of a size that does not allow a person to pass through. The blockage on the other side of the passage that accommodates the mantrap on the other hand is what is called a comb rake. It also consists of separated grating rods positioned one over another. They are positioned displaced from the grating rods in the leaves of the barrier element in the form of a turnstile such that, when the barrier element is rotated around its upright axis the grating rod in the leaves can always pass unimpeded between adjacent grating rods in the blockage.

The known mantrap can be equipped with a simple backward-rotation prevention mechanism or with an electromechanical locking mechanism for the turntable and accordingly rotate in one or both senses. The mantrap can accordingly be employed either as an entry mantrap, as an exit mantrap, or as a combination of both.

Such mantraps are often employed for the external security of industrial premises and are integrated into the fences, walls, or other enclosures that surround them. One problem of the known mantrap is that it does not allow for the transport of heavy burdens. Another is that it does not comply with the demand for escape routes in the event of emergencies. Additional passages must accordingly be provided in the form of gates for transporting burdens and for escape routes. The gates are positioned in the enclosures adjacent to the mantraps and can be opened when necessary. This is costly. It is also problematic in the event of emergencies in that the escape routes differ from the regular passages.

SUMMARY OF THE INVENTION

The present invention is on the other hand intended as a structurally simple mantrap that can when necessary be converted rapidly and in a simple way into a large passageway that will allow the transport of burdens or can be exploited as an escape route but wherein an unintended passageway can not occur no matter what position the turnstile is in.

This object is attained in the mantrap in accordance with the present invention in that the barrier rake is a gate element that moves between a closed position and a position that opens a passageway and in that the barrier element is a rotating door with at least two leaves.

In contrast to the state of the art, a wide passageway can be created in the vicinity of the passage accommodating the mantrap in accordance with the present invention simply by actuating the gate element, which can be locked closed, into its open position while simultaneously rotation-adjusting the rotating door such that each leaf covers the arc-segment shaped lateral demarcation. This passageway can be used as either a burden-transporting way and/or an escape route. That the escape route practically coincides with the regular access ways is of particular significance for its use as an escape route.

The gate element in one advanced version of the invention can swing around an upright axis between its closed position and its open position. When circumstances allow, on the other hand, the gate element can slide back and forth longitudinally within the scope of the invention and accordingly be brought into its open position by sliding.

The arc-segment shaped demarcation in another sensible advanced version extends over a circumferential angle of no more than 180°. The leaves of the rotating door extend out from the axis of the door toward mutually opposite sides.

Such a mantrap is particularly simple in design and cost-effective as well as being outstanding in that all that is necessary to obtain a wide passageway is to adjust the rotating door to a position that covers the arc-segment shaped demarcation and to swing the gate element into its open position.

The rotating door in another advantageous advanced version is a turnstile with at least three leaves and at least one leaf can be swung toward the adjacent leaf around an axis of articulation parallel the axis of the rotating door.

The overall passageway between the rotating-door axis and the other side of the passage in this advanced version as in the case of a rotating door with two leaves is opened with the gate element in the open position when the rotating door is at a rotation at which two adjacent leaves cover the arc-segment shaped demarcation and the other leaf has been swung into a position, perpendicular to the closed position of the gate element for example.

It is of course possible to employ instead of a three-leaf turnstile a four-leaf turnstile in conjunction with a arc-segment shaped demarcation extending over a circumferential angle of up to 180°. With such a circumferential extension of the lateral demarcation it is possible to adjust the turnstile such that only one leaf projects into the passageway. In this case the leaf will have to be as capable as in a three-leaf design of swinging into a position more or less perpendicular to the closed position of the gate element in order to open a wide passageway when desired.

It is characteristic of the mantrap in accordance with the present invention that when the gate element is in the closed position the mantrap basically can be traversed only through the actual mantrap-space, specifically along the path prescribed by the arc-segment shaped demarcation, while simultaneously rotating the rotating door. An uncontrolled opening of the rotating door in the vicinity of the mantrap can accordingly occur no matter-what position the rotating door has been rotated to.

The gate element is within the scope of another practical advanced version articulated to or in the vicinity of the rotating-door axis, and can accordingly swing around that axis into an open position at a right angle to its closed position, leaving a wide passageway open.

The gate element, however, can analogously be articulated at an axis parallel to the rotating-door axis and swing toward the side of the passage remote from the rotating door.

Another advanced version provides an arc-segment shaped demarcation with a rotating door on each side of the passage whereby between the rotating doors a gate element extends all the way to the axes of the rotating doors and is articulated to or swings into the vicinity of one rotating-door axis.

This advanced version is accordingly a double-mantrap system wherein a gate element consisting of two gate leaves can be employed instead of a single gate element. Each gate leaf is articulated swinging on or in the vicinity of a rotating-door axis between a closed position and an open position.

The end of each gate leaf remote from the axis of articulation extends all the way to the corresponding end of the other gate leaf. Both gate leaves can be locked into position, at least in their closed positions.

It has also turned out to be practical in this advanced version for the frame of the gate leaf to be made of lengths of U section. The upright lengths are connected by a web. The free ends of the lengths are mounted swinging to the top and bottom of the associated rotating-door axis or in their vicinities. Grating rods that are separated and positioned one above another extending parallel to the rotating-door axis extend almost as far as the particular rotating-door axis.

A mantrap is admittedly known from European Application 0 364 648 that can be converted from a normal mantrap path to a wider passageway. This mantrap, however, is not designed with a rotating door or turnstile. It is a suspended mantrap, particularly intended for monitoring and protecting the entries of buildings.

This mantrap has as a demarcation on one side a semicylindrical wall, and its barrier element is a semicylindrical surface mounted rotating in the center of the semicylindrical wall and, in one of its positions, extending the wall into a complete cylinder. Between the barrier element in the form of a semicylinder and the wall that demarcates the passage is a leaf door. The leaf door is articulated swinging on the wall. The door can swing between a closed position that extends as far as the semicylinder that constitutes the rotating barrier element and an open position at a right angle thereto.

The barrier element in the form of a semicylindrical surface in the known suspended mantrap rotates into four position. In the first position, the mantrap is closed on both sides. In two other positions, it is open on one side. In the fourth, it is open on both sides. Although the passageway is admittedly wider in the last position, there is a drawback. It demands precise control of the rotation of the barrier element and especially of how it is locked into one or another terminal position. Otherwise there could be an undesired rotation of the barrier element into the fourth position, in which an undesired and especially uncontrolled passageway could occur independent of the actual mantrap passage.

With reference to the invention, in accordance with which an uncontrolled opening in the vicinity of the mantrap can not occur no matter what position the rotating door is in, the mantrap known from European Patent 0 364 648 can provide no intimation because the pressure positions of the barrier element that allow unsecured access at the state of the art can be overcome only with considerably complicated control technology, whereas the security occurs automatically in accordance with the present invention.

BRIEF DESCRIPTION OF THE DRAWINGS

Several embodiments of the present invention will now be specified with reference to the drawing, wherein.

DESCRIPTION OF THE PREFERRED EMBODIMENTS

Figure 1:
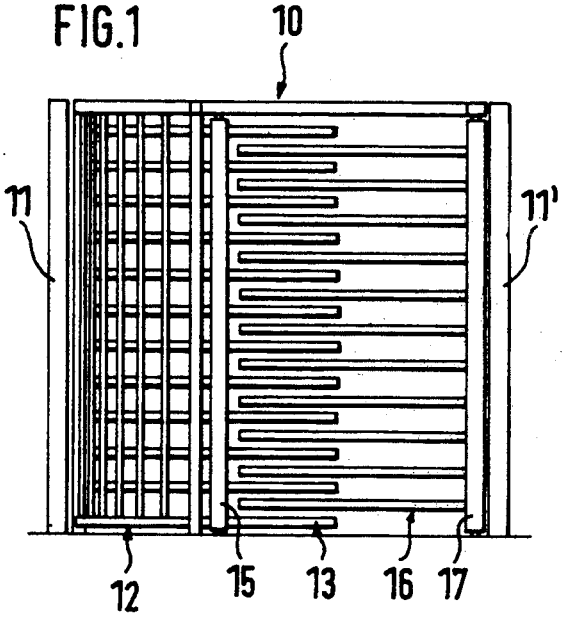
FIG. 1 is a front view of a mantrap with a two-leaf rotating door and a gate element articulated to swing back and forth between a closed position and an open position to one side of a passage that accommodates the mantrap.

An arc-segment shaped demarcation 12 is positioned at one side of a passage in the mantrap 10 illustrated in FIGS. 1 through 5. The passage is produced by two schematically indicated posts 11 and 11' and is part of a barrier system otherwise of no interest in the present context. Demarcation 12 is immediately adjacent to post 11. The demarcation is essentially constructed of vertical grating rods. It extends over a circumferential angle of approximately 180°. Its open side faces the post 11' that demarcates the other side of the passage.

The mantrap also comprises a rotating barrier element in the form of a rotating door 13 with two wings 14 and 14' that rotate around a vertical axis 15 at the center of the arc-segment shaped demarcation. Wings 14 and 14' extend out of axis 15 in opposite directions. The wings are constructed of grating rods positioned one above another at intervals.

Mantrap 10 also includes, finally, a gate element 16 in the form of a barrier rake. Gate element 16 extends between the post 11' more remote from arc-segment shaped demarcation 12 and the axis 15 of rotating door 13. The gate element is articulated to a vertical axis 17 immediately adjacent to the side of the passage more remote from arc-segment shaped demarcation 12 and swings back and forth between the closed position indicated in FIGS. 1 through 3 and the open position indicated in FIGS. 4 and 5. Gate element 16 is constructed essentially of grating rods positioned one above another at intervals. The rods extend between the axis 17 of gate element 16 and, while the gate element is in the closed position, the axis 15 of rotating door 13. The grating rods in gate element 16, however, are vertically displaced in relation to the grating rods in wings 14 and 14' such that the rods in the wings can pass unimpeded through the intervals between the rods in the gate element when rotating door 13 swings.

Aside from the articulation of gate element 16 that allows it to swing around an upright axis at the side of the passage accommodating mantrap 10, the mantrap illustrated in FIGS. 1 through 5 is constructed along the lines of known turnstile systems.

Figure 2:
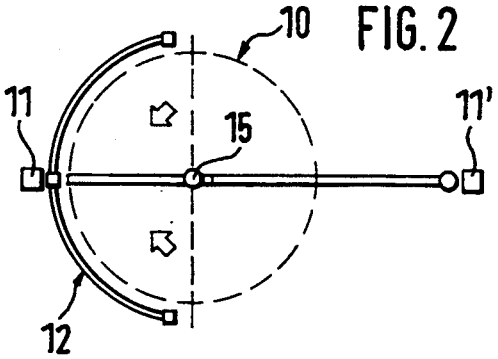
FIG. 2 is a top view of the mantrap illustrated in FIG. 1, showing the gate element in the closed position and the rotating door rotated into a position in alignment with the gate element.

In the operating position illustrated in FIGS. 1 and 2, the gate element 16 articulated to one side of the passage accommodating mantrap 10 and the rotating door 13 rotating around a vertical axis 15 at the center of arc-segment shaped demarcation 12 are in alignment. The mantrap is accordingly closed. When someone wants to pass through the mantrap in the direction indicated by the arrow in FIG. 2, the rotating door is released and can rotate to the left or to the right around its vertical axis depending on what direction the person is going in.

Figure 3:
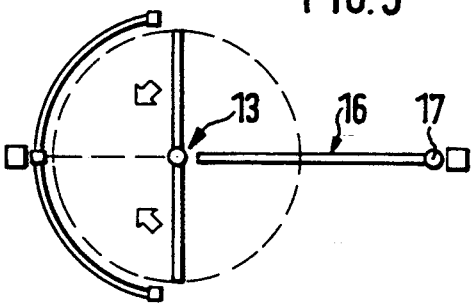
FIG. 3 is another top view of the mantrap illustrated in FIG. 1, with the gate element in the closed position and the rotating door rotated into a position perpendicular thereto.

FIG. 3 illustrates the rotating door rotated into a position such that the person passing through the mantrap can find himself in the vicinity of the mantrap. The area of the passage next to the mantrap is blocked in this operating position by gate element 16, which is in the closed position, extends almost to the axis 15 of rotating door 13, and is constructed in the shape of a barrier rake.

Figure 4:
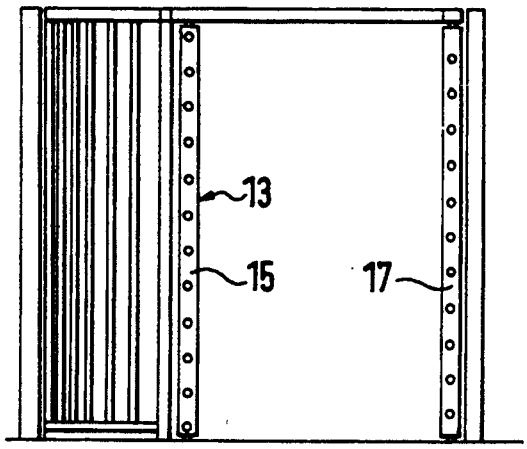
FIG. 4 is a front view of the mantrap with the rotating door in the position indicated in FIG. 3 and with the gate element in the open position.
Figure 5:
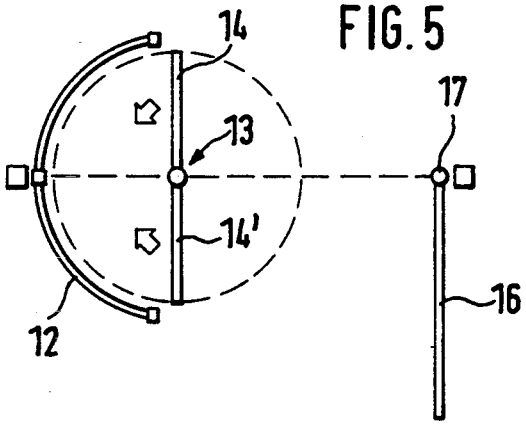
FIG. 5 is a top view of the situation represented in FIG. 4.

FIGS. 4 and 5 on the other hand represent an operating position wherein the rotating door 13 is in the position indicated in FIG. 3 whereas the gate element 16 articulated to the other side of the passage has been swung into an open position paralleling this position of the rotating door. This operating position allows uncontrolled passage and functioning as either an escape route or for carrying a burden.

Figure 6:
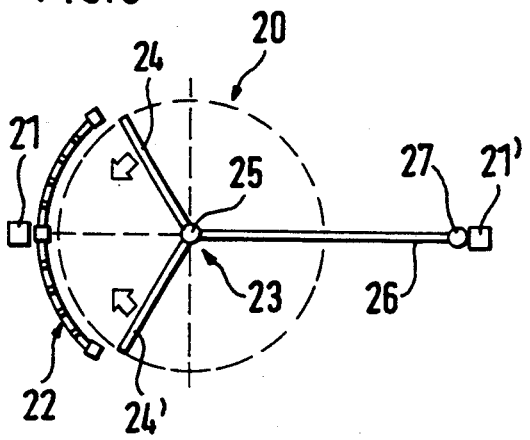
FIG. 6 is a top view similar to FIG. 3 of a mantrap with a rotating door in the form of a three-leaved turnstile, whereby the gate element is in the closed position.
Figure 7:
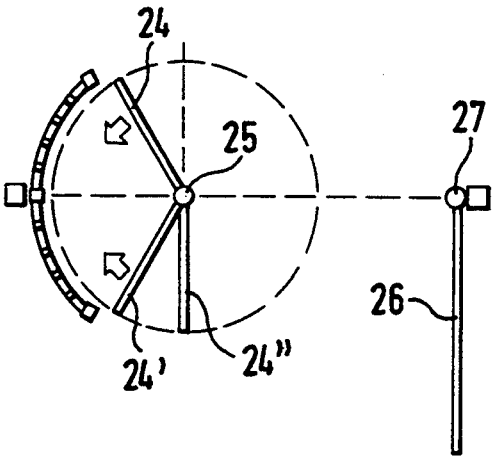
FIG. 7 is another top view illustrating the mantrap from FIG. 6 with the gate element in the open position and one of the rotating door's wings swung into a position paralleling the gate element.

The parts of the structures illustrated in FIGS. 6 and 7 that are similar to the parts illustrated in FIGS. 1 through 5 are labeled with the same reference numbers plus ten.

The mantrap 20 illustrated only in top views in FIGS. 6 and 7 differs from the embodiment illustrated in FIGS. 1 through 5 only in that the rotating barrier element is a turnstile 23 with three leaves 24, 24', and 24''. Leaves 24, 24', and 24'' extend out of an axis 25 including equal circumferential angles. The mechanism is accordingly a real turnstile system, and its arc-segment shaped demarcation 22, positioned at one side of the passage accommodating the mantrap, extends over approximately 120°, matching the angle between adjacent leaves.

FIG. 6 illustrates the mantrap 10 in the blocking position. The gate element 26 articulated to and swinging around a vertical axis adjacent the post 21' on the side of the passage accommodating the mantrap is in its closed position and extends almost to the axis 25 of the rotating door. One leaf 24'' of the rotating door is in alignment with the gate element, in its closed position. The other two leaves 24 and 24' extend to the ends of arc-segment shaped demarcation 22.

FIG. 7 illustrates the system in the operating position allowing uncontrolled passage and carrying burdens. Gate element 26 has been rotated into a position that differs 90° from the closed position. The leaf 24'' that extends toward the gate element in FIG. 6 has been rotated around an axis coincidental with the axis 25 of the rotating door toward one of the other leaves into a position paralleling the open position of the gate element.

In the double system illustrated in FIGS. 8 through 12 there is an arc-segment shaped demarcation 32 and 32' on each side of a passage that accommodates a mantrap 30. Associated with the demarcation are rotating doors 33 and 33'. Articulated to each axis 35 and 35' is a gate leaf 36 and 36' that swings between a closed position and an open position. These gate elements consist of lengths of U section. The free ends of the lengths rotate around the top and bottom of each rotating-door axis 35 and 35'. Grating rods positioned at intervals one above another extend out of webs connecting the lengths of U section and toward the axis of the rotating door.

Figure 11:
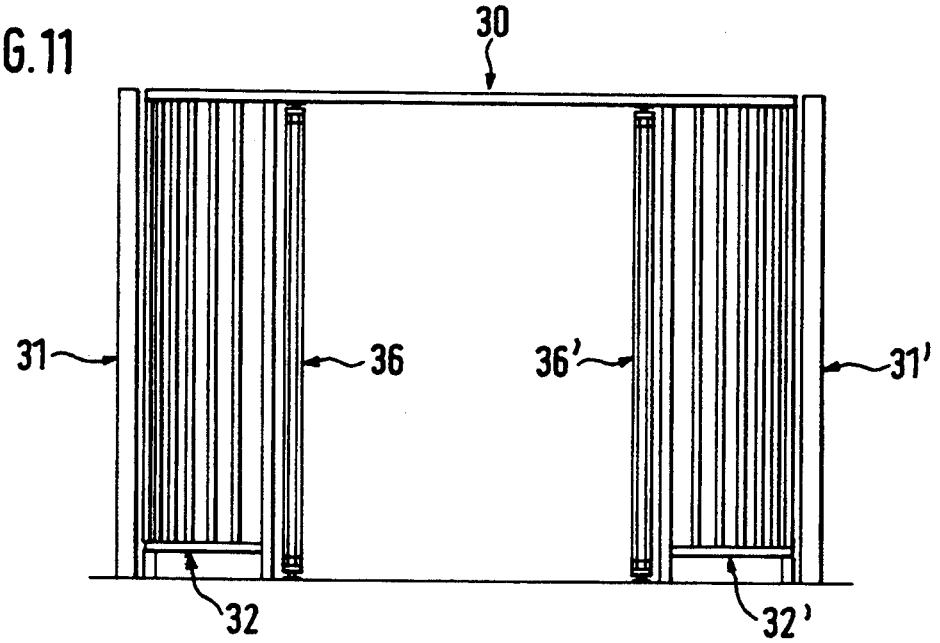
FIG. 11 is a front view of the double mantrap illustrated in FIG. 8 with the rotating doors rotated into the position represented in FIG. 10 and with the gate element in the open position.
Figure 12:
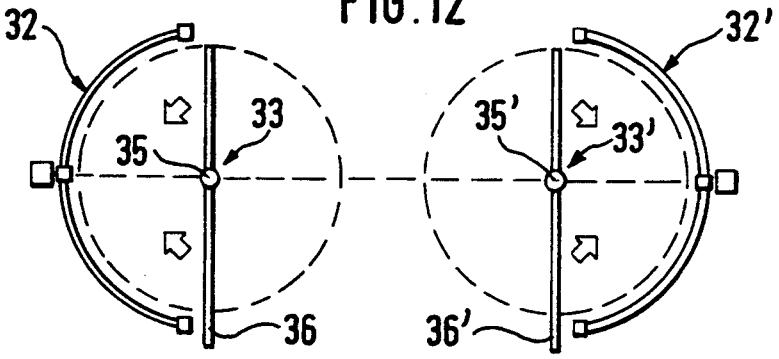
FIG. 12 is a top view of the situation represented in FIG. 11, illustrating the double mantrap with the gate elements in the open position.
Figure 8:
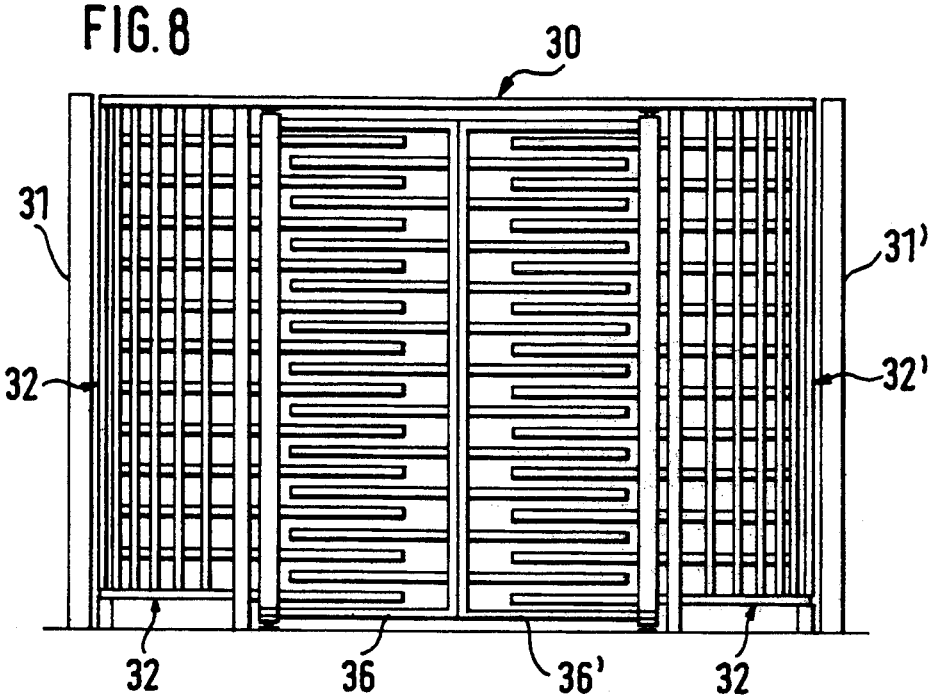
FIG. 8 is a front view of a double mantrap with separated rotating doors, each with gate element articulated swinging to it axis.
Figure 9:
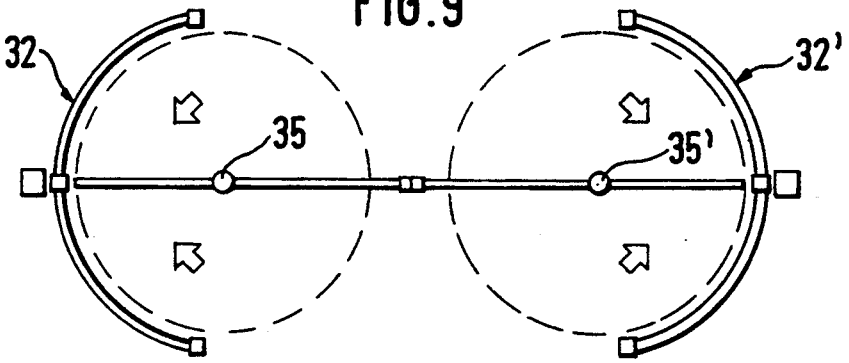
FIG. 9 is a top view of the situation in FIG. 8 with the rotating doors in a position in alignment with gate elements in the closed position.
Figure 10:
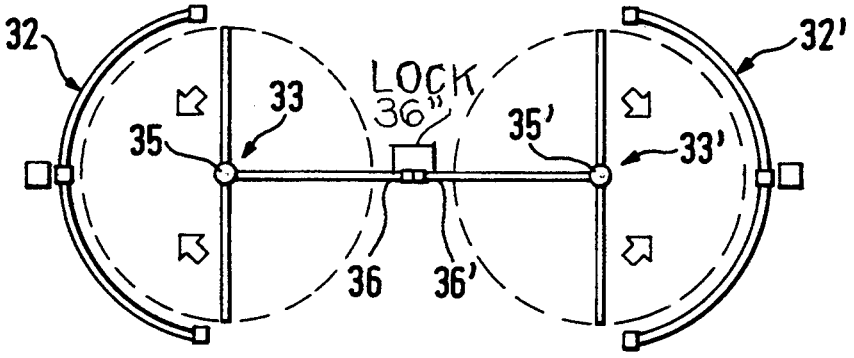
FIG. 10 is another top view of the situation in FIG. 8 showing the double mantrap with its gate elements in the closed position and the rotating doors rotated into a position perpendicular to the blocking position illustrated in FIG. 9.

Like FIGS. 2 and 3, FIGS. 9 and 10 represent the normal operation of the double-mantrap system with gate leaves 36 and 36' in the closed position and locked into that position by a conventional lock 36''. FIGS. 11 and 12 on the other hand, like FIGS. 4 and 5 with respect to the first embodiment, illustrate adjusting the double-mantrap system to allow carrying burdens or as an escape route in dangerous situations. The barrier elements are two-leaf rotating doors 33 and 33'. They are in a position that entirely unblocks the passageway between rotating-door axes 35 and 35'. Gate leaves 36 and 36' are likewise rotated into an open position in alignment with the aforesaid position that the rotating doors have been rotated into.

I claim:

1. A mantrap comprising: a demarcation in shape of a segment of an arc at one side of a passage, said demarcation having an open side facing the other side of the passage; said demarcation extending along a predetermined angle of circumference and having a barrier element rotating around a vertical axis positioned approximately in a center of the demarcation and having leaves extending out from the vertical axis of rotation and including equal angles and comprising grating rods positioned separately and one above another; a barrier rake extending out from an axis of said barrier element to the other side of the passage, said barrier rake comprising grating rods displaced in position from the grating rods in said leaves and one above another; said barrier-rake rods allowing unimpeded rotation of the barrier element; said barrier rake being a gate element movable between a closing position and a releasing position; said barrier element being a rotating door with at least two leaves.

2. A mantrap as defined in claim 1, wherein the arc-segment shaped demarcation extends over a circumferential angle of no more than 180°, said leaves of said rotating door extending toward opposing sides of an axis of the rotating door.

3. A mantrap as defined in claim 1, wherein said rotating door is a turnstile with at least three leaves, one of said leaves swinging around an axis parallel to an axis of the rotating door.

4. A mantrap as defined in claim 1, wherein said barrier element comprises further a swinging articulation in form of a gate element around an upright axis.

5. A mantrap as defined in claim 4, wherein the swinging articulation of the gate element is adjacent said axis of the rotating door.

6. A mantrap as defined in claim 4, wherein the swinging articulation of the gate element has an axis of articulation at a side of said passage spaced from the rotating door.

7. A mantrap as defined in claim 4, wherein an arc-segment shaped demarcation with a rotating door is positioned on each side of said passage, said gate element extending between each of said arc-segment shaped demarcation and said axes of the rotating door and is articulated swinging adjacent the rotating-door axis.

8. A mantrap as defined in claim 7, wherein said gate element comprises two gate leaves, each gate leaf being articulated adjacent a rotating-door axis swinging back and forth between a closed position and an open position, each gate leaf having an end spaced from the axis of articulation of the gate leaf and extending to a corresponding end of the other gate element, both gate leaves being lockable into at least their closed positions.

9. A mantrap as defined in claim 8, wherein said gate leaves have lengths of U section connected by webs, said gate leaves having free ends rotating at top and bottom of the associated rotating-door axis; said grating rods positioned separately and one above the other extending out from the webs of said gate leaves substantially parallel to the rotating-door axes.

10. A mantrap comprising: a demarcation in shape of a segment of an arc at one side of a passage, said demarcation having an open side facing the other side of the passage; said demarcation extending along a predetermined angle of circumference and having a barrier element rotating around a vertical axis positioned approximately in a center of the demarcation and having leaves extending out from the vertical axis of rotation and including equal angles and comprising grating rods positioned separately and one above another; a barrier rake extending out from an axis of said barrier element to the other side of the passage, said barrier rake comprising grating rods displaced in position from the grating rods in said leaves and one above another; said barrier-rake rods allowing unimpeded rotation of the barrier element; said barrier rake being a gate element movable between a closing position and a releasing position; said barrier element being a rotating door with at least two leaves; said barrier element comprising further a swinging articulation in form of a gate element around an upright access; the arc-segment shaped demarcation extending over a circumferential angle of no more than 180°, said leaves of said rotating door extending toward opposing sides of an axis of the rotating door; said rotating door being a turnstile with at least three leaves, one of said leaves swinging around an axis parallel to an axis of the rotating door; the swinging articulation of the gate element being adjacent said axis of the rotating door; the swinging articulation of the gate element having an axis of articulation at a side of said passage spaced from the rotating door; an arc-segment shaped demarcation with a rotating door being positioned on each side of said passage, said gate element extending between each of said arc-segment shaped demarcation and said axes of the rotating door and being articulated swinging adjacent the rotating-door axis.

11. A mantrap comprising: a demarcation in shape of a segment of an arc at one side of a passage, said demarcation having an open side facing the other side of the passage; said demarcation extending along a predetermined angle of circumference and having a barrier element rotating around a vertical axis positioned approximately in a center of the demarcation and having leaves extending out from the vertical axis of rotation and including equal angles and comprising grating rods positioned separately and one above another; a barrier rake extending out from an axis of said barrier element to the other side of the passage, said barrier rake comprising grating rods displaced in position from the grating rods in said leaves and one above another; said barrier-rake rods allowing unimpeded rotation of the barrier element; said barrier rake being a gate element movable between a closing position and a releasing position; said barrier element being a rotating door with at least two leaves; said barrier element comprising further a swinging articulation in form of a gate element around an upright axis; an arc-segment shaped demarcation with a rotating door being positioned on each side of said passage, said gate element extending between each of said arc-segment shaped demarcation and said axes of the rotating door and being articulated swinging adjacent the rotating-door axis; said gate element comprising two gate leaves, each gate leaf being articulated adjacent a rotating-door axis swinging back and forth between a closed position and an open position, each gate leaf having an end spaced from the axis of articulation of the gate leaf and extending to a corresponding end of the other gate element, both gate leaves being lockable into at least their closed positions.

* * * * *